United States Patent [19]

Gramling

[11] 4,070,134

[45] Jan. 24, 1978

[54] GAS POWERED SWABBING DEVICE

[76] Inventor: William Dwight Gramling, 5144 Newport Ave., Chevy Chase, Md. 20016

[21] Appl. No.: 687,916

[22] Filed: May 19, 1976

Related U.S. Application Data

[63] Continuation-in-part of Ser. No. 569,056, April 17, 1975, abandoned, which is a continuation of Ser. No. 431,910, Jan. 9, 1974, abandoned.

[51] Int. Cl.[2] ..... F04B 47/12

[52] U.S. Cl. ..... 417/56

[58] Field of Search ..... 417/56–60

[56] References Cited

U.S. PATENT DOCUMENTS

| | | | |
|---|---|---|---|
| 1,836,871 | 12/1931 | Ricker | 417/56 |
| 1,846,000 | 2/1932 | Fletcher | 417/60 |
| 1,919,547 | 7/1933 | Fletcher | 417/60 |
| 2,267,902 | 12/1941 | Eddins | 417/60 |

*Primary Examiner*—William L. Freeh

[57] ABSTRACT

Means for utilizing natural gas pressure to operate a free-floating pressure-sensitive swab to automatically remove fluids from well casings. Also included are means to reduce free-fall speed of the swab, means to manually release pressure under swab in case of sticking, and means to provide a stand at the bottom of the well casing.

6 Claims, 3 Drawing Figures

GAS POWERED SWABBING DEVICE

This is a continuation-in-part of application Ser. No. 569,056 dated 4/17/75 now abandoned, which in turn is a continuation application of Ser. No. 431,910 filed Jan. 9, 1974 now abandoned.

BACKGROUND OF THE INVENTION

1. Field of the Invention

The present invention relates to the field of well fluid removal.

2. Description of Prior Art

The accumulation of fluids in natural gas well casings restrict the flow by exerting high pressure on the face of the producing formation. Present methods of removal are expensive and impractical for small wells. One such method is dipping the liquid out of the casing with a long bucket or 'swab' operated by a cable from a truck-mounted winch. Other devices, impractical because of cost, include pump-jacks with associated equipment and gas-operated systems wherein a high back pressure must be maintained in the well to operate.

SUMMARY OF THE INVENTION

The primary object of the present invention is to provide a low cost method of removing fluids from natural gas wells. Another object is to restrict the rate of fall of the device into the well. A further object is to provide means for manually releasing pressure under the device for safety. Another object is to provide a stop at the bottom of the casing to restrict the downward movement of the device.

BRIEF DESCRIPTION OF THE DRAWING

Referring to the illustration.

DESCRIPTION OF THE PREFERRED EMBODIMENTS

Figure 1:
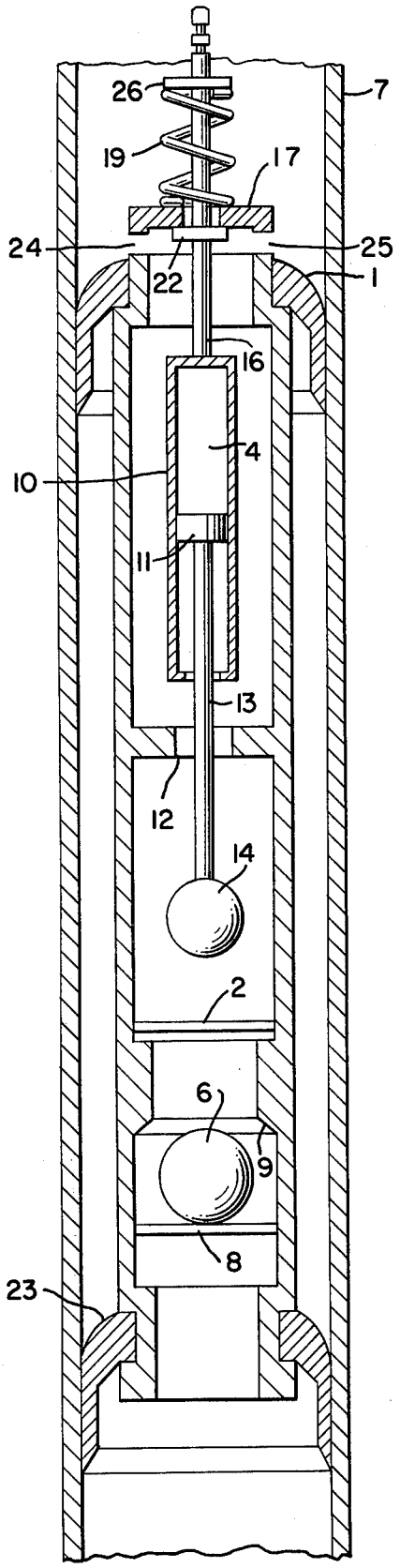
FIG. 1 shows the internal construction of the present invention.

Referring to FIG. 1, the swabbing device is placed into the casing 7 of the natural gas well after a stand is lowered to the bottom. The position of the stand is such that the device is held slightly above the casing perforations at the producing formation when all liquids are removed. Since the device is quite heavy, the speed at which it would fall to the bottom without any braking would be such as to cause excessive wear on the seals 1, 23. A heavy ball 6 rests on pin 8 when the device is at rest. When the device is falling through the casing, the force of the rushing gas through the device combined with the reduction in the relative weight of the ball 6 due to its falling, lifts it into the restricting orifice 9. The pin 2 stops the ball 6 in its upward travel at that point. The ball 6 is slightly smaller in diameter than the orifice 9, leaving a small opening for the gas that is passing through the device. The resultant increased pressure under the device slows its descent to a reasonable speed. When the device arrives at the liquid the ball 6 falls back to the pin 8 because the device moves through the liquid more slowly than would the ball if it were free. The liquid flows through the device freely now that the ball 6 is removed from the orifice 9.

The swabbing device, pulled by gravity, drifts down through the fluid. An air chamber 4, formed by a cylinder 10 enclosing a sealed piston 11, contains atmospheric pressure when removed from the well. Attached to the piston 11 by means of rod 13 is a valve ball 14. The pressure of the liquid in and around the device increases as it descends deeper into the liquid. The pressure in the chamber 4 is equalized to the liquid pressure by the moving of the piston 11 upward in the cylinder 10. At a predetermined depth in the liquid the piston 11 has pulled the valve ball 14 against the valve seat 12. This action stops the flow of gas through the device and pressure begins to increase under it. The increased pressure lifts the device and the liquid above it to the top of the well. The liquid flows into a holding tank through a liquid-gas separator resulting in a reduction of pressure surrounding the air chamber 10. The pressure inside of the air chamber 10 re-equalizes by the downward movement of the piston 11. This, in turn, forces the valve ball 14 off its seat 12, allowing the trapped gas to escape and the device to descend back into the well to repeat the cycle until all liquids have been removed.

Figure 2:
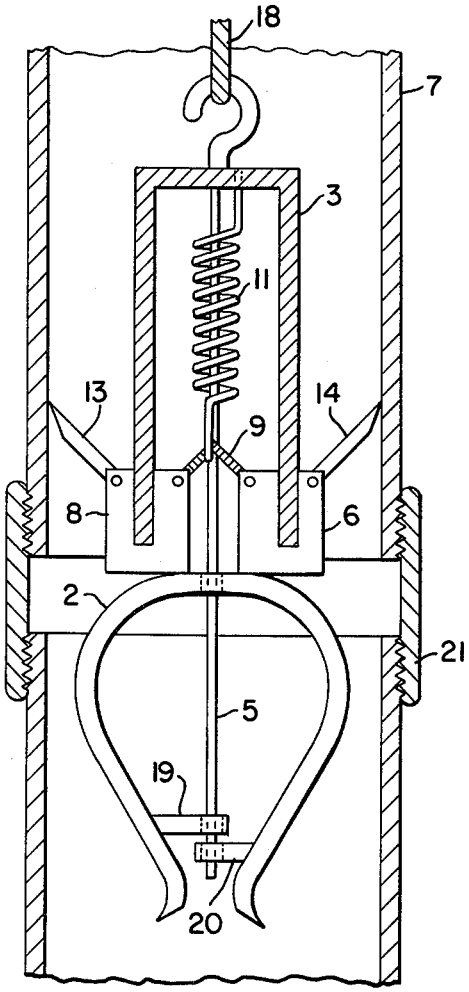
FIG. 2 illustrates a stand for the swabbing device, and the stand-ejecting device being lowered into the casing.
Figure 3:
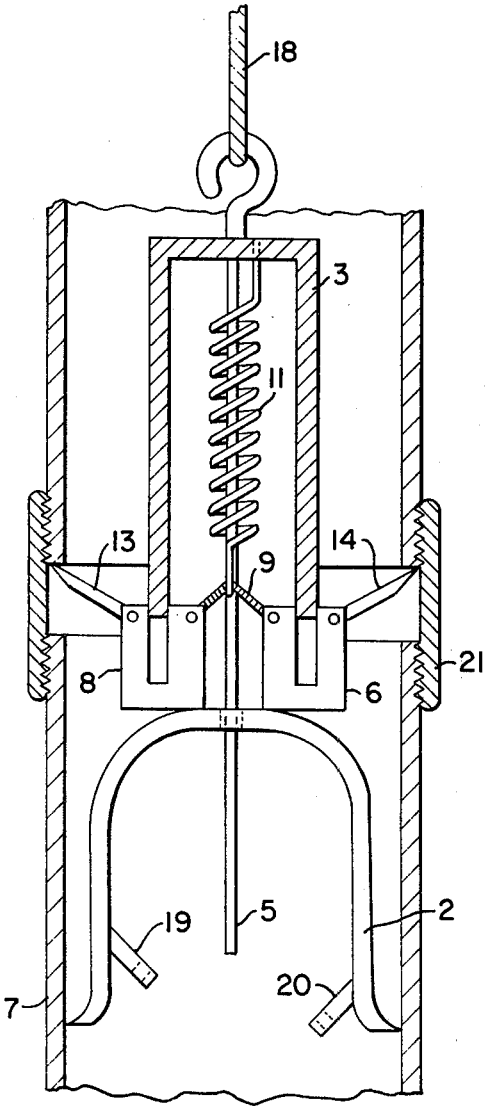
FIG. 3 illustrates the ejecting device being raised for the purpose of ejecting the stand at a predetermined depth in the casing.

Should the device become stuck due to an obstruction in the casing or sand around the seals 1, 23, a manual plunger rod 16is provided to force the valve ball 14 off its seat 12. This allows the freeing of the device without a dangerous buildup of pressure under it. The plunger rod 16 is attached to the top of the cylinder 10 and is the cylinder's only support. The flanges 22, 26 are welded or otherwise firmly attached to the plunger rod 16. The plunger rod-cylinder assembly is supported in place by the flange 22 being held against the top of the device by the pressure of the spring 19 pushing upward against the flange 26. This design will allow a weight which has been lowered by cable into the well casing, resting on top of the plunger rod 16 to force, through the cylinder top against the piston 11 and rod 13, the valve ball 14 off its seat 12, allowing any buildup of pressure to be released. The plunger rod 16 is of sufficient length to allow the unseating of the valve ball 14 off its seat 12 even if the air chamber 4 loses its charge due to a leak or rupture of the cylinder 10. Such a loss of charge in the air chamber 4 would allow the piston 11 to contact the top of the cylinder 10. Orifices 24, 25 are provided at the top of the device to allow passage of fluids through the device. A stand is necessary to prevent the swab device from passing below the perforations in the well casing where the gas enters, rendering it useless. Referring to FIGS. 2 and 3, the preferred embodiment of a stand is a spring-steel bar 2, shown compressed in FIG. 2 and expanded against the well casing in FIG. 3. The ejecting device consists of a cylindrical body 3 capped at the top and open at the lower end with a steel rod 5 fixed to the cap and protruding down through and beyond the end of the body 3. Slidable on the bottom of the body 3 are two fittings 6, 8. The fittings 6,8 are joined by a flexible cable 9 which is connected to the body 3 by an expanded spring 11. The spring 11 holds the fittings 6,8 upwards against the body 3. Tabs 13, 14 are hinged to the top of the fittings 6, 8 and are held in a downward tension against the well casing 7 by springs incorporated into the hinges. The downwardly-facing semi-circle of spring steel bar 2 is compressed and placed on the rod 5 through a hole at the top of the bar 2 and through holes in the two tabs 19, 20 which have been attached to the bar 2. The tabs 19, 20 hold the bar 2 in compression and the spring tension of the bar 2 against the rod 5 supports the weight of the bar 2 until the bar is ejected. The body 3 is attached to a cable 18 for purpose of lowering the ejecting device into the well casing. The operation of the stand-ejecting device is as follows: The ejecting device with the spring steel bar stand 2 attached to the rod 5 is lowered into the well casing to a predetermined depth. The tabs 13, 14 are presently oriented upward and slide along the casing wall, offering no resistance to the downward movement of the ejecting device. When the device and stand are several feet above the predetermined depth, they are pulled back toward the top of the casing. When the device passes the pipe connector 21, the tabs 13, 14 catch in the indentation formed by the joining of two pipe casings by the pipe connector 21. This arrests the upward movement of the fittings 6, 8 and, consequently, the bar 2. However, the body 3 and the rod 5 continue to move upward, pulled by the cable 18. The rod 5 slides out of the holes in tabs 19, 20, allowing the bar 2 to spring out against the sides of the casing 7. When the fittings 6, 8 reach their bottommost travel on the body 3, they are pushed upward partially into the body 3 by the spring 11. The tabs 13, 14 have folded downward and the entire ejecting device is now free to be pulled upward and removed from the well casing. The bar 2 has been ejected and is positioned in the well casing. When pushed down to the next pipe connector, the bar 2 will serve as a stand for the swabbing device.

Another embodiment of the ejecting device is to incorporate a cylindrical enclosure in place of the rod 5. The enclosure is open at both ends, one end attached to the open lower end of the body 3. The enclosure is notched at the top to allow downward movement of the fittings 6, 8 and its inside diameter is large enough to accommodate the insertion of the compressed bar 2. The enclosure holds the bar 2 in its compressed state until the downward movement of the fittings 6, 8 eject the bar 2 out of the enclosure into the well casing.

What I claim is:

1. Means for removing fluid from wells which produce both gas and liquid which comprises a swab means for being receiving in the well casing and being slidable in the well casing, said swab means including cup sealing means bearing against said casing and performing the function of selectively providing a seal between the casing below said swab means and above said swab means and reducing friction at the bearing surfaces between said swab means and said casing, said swab means having a vertically disposed fluid passage therethrough, a valve seat in said passage and an upwardly sealing valve therein, resilient means tending to hold said valve normally opened, said valve being closed by liquid pressure when submerged a predetermined depth, a pressure relief mechanism included across said passage for selectively relieving the pressure differential below and above said swab means within said casing.

2. Means in accordance with claim 1 wherein said pressure relief mechanism is operated by exerting a downward force on said valve via a vertically disposed member protruding from the top of said swab means and mechanically coupled to said valve.

3. Means in accordance with claim 2 wherein said pressure relief mechanism is operated by exerting a downward force on said valve via a vertically disposed member protruding from the top of said swab means and mechanically coupled to said valve via said resilient means.

4. Means in accordance with claim 3 wherein said resilient means comprises a compressible fluid in a piston and cylinder combination.

5. Means for removing fluid from wells which produce both gas and liquid which comprises a swab means for being receiving in the well casing and being slidable in the well casing, said swab means including cup sealing means bearing against said casing and performing the function of selectively providing a seal between the casing below said swab means and above said swab means and reducing friction at the bearing surfaces between said swab means and said casing, said swab means having a vertically disposed fluid passage therethrough, a valve seat in said passage and an upwardly seating valve therein, resilient means tending to hold said valve normally opened, said valve being closed by liquid pressure when submerged a predetermined depth, automatic passage restricting means in said passage to reduce the descent velocity of said swab means relative to said casing, said passage restriction means comprising a ball valve in said passage which is caused to rise to a more restricted location provided in said passage above ball valve by the relative movement of gas through said passage during the descent of said swab means relative to said casing, said restriction being operable prior to the operation of said first mentioned value.

6. Means in accordance with claim 5 wherein said ball valve is a sphere of steel.

* * * * *